United States Patent [19]

Gedeon et al.

[11] Patent Number: 4,980,123

[45] Date of Patent: Dec. 25, 1990

[54] PROCESS FOR OBTAINING A METALLURGICAL BOND BETWEEN A METAL MATERIAL, OR A COMPOSITE MATERIAL HAVING A METAL MATRIX, AND A METAL CAST PIECE OR A METAL-ALLOY CAST PIECE

[75] Inventors: Steve A. Gedeon; Renato Guerriero; Ilario Tangerini, all of Venice, Italy

[73] Assignee: Temav S.p.A., Venice, Italy

[21] Appl. No.: 408,268

[22] Filed: Sep. 18, 1989

[30] Foreign Application Priority Data

Feb. 22, 1989 [IT] Italy ..... 19516 A/89

[51] Int. Cl.[5] ..... B22F 7/00

[52] U.S. Cl. ..... 419/8; 419/9; 419/10; 419/23; 419/24; 419/35; 75/232; 75/245; 75/238; 75/236

[58] Field of Search ..... 419/8, 9, 10, 24, 23, 419/35; 75/232, 245, 236, 238

[56] References Cited

U.S. PATENT DOCUMENTS 4,710,235 12/1987 Scruggs ..... 148/4

4,855,101 8/1989 Mohs et al. ..... 419/8

*Primary Examiner*—Stephen J. Lechert, Jr.

*Assistant Examiner*—Nina Bhat

*Attorney, Agent, or Firm*—Oblon, Spivak, McClelland, Maier & Neustadt

[57] ABSTRACT

Disclosed is a process for obtaining a metallurgical bond between a metal material, or a composite material having a metal matrix, and a metal casting, or a metal alloy casting, which comprises carrying out a surface treatment on said material by means of the deposition of a thin layer of a metal, generally different from the metals contained in the material and in the casting, which is capable of increasing the wettability between the metal of the casting and the material, as well as the heat transfer coefficient between said two partners; and a step of casting around the same material, positioned inside a mold, of the metal, or of the metal alloy the same casting is constituted by.

18 Claims, 2 Drawing Sheets

Fig.1
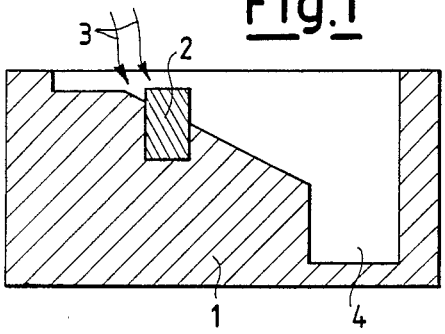
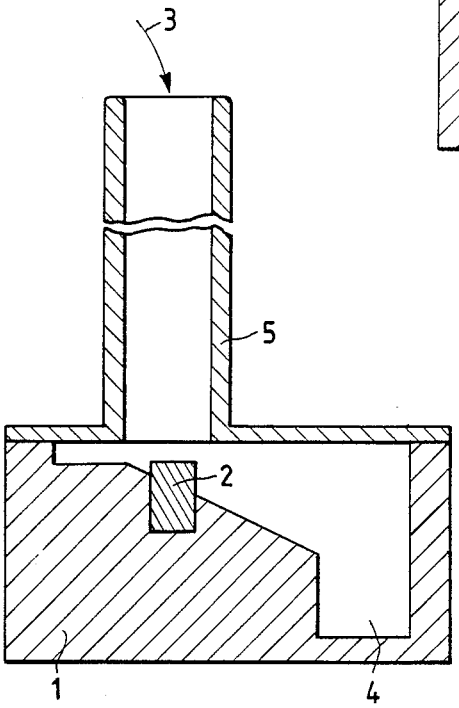
Fig.3
Fig.5
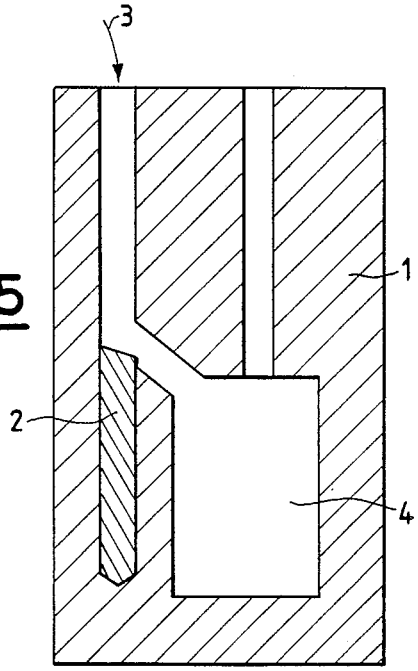

PROCESS FOR OBTAINING A METALLURGICAL BOND BETWEEN A METAL MATERIAL, OR A COMPOSITE MATERIAL HAVING A METAL MATRIX, AND A METAL CAST PIECE OR A METAL-ALLOY CAST PIECE

The present invention relates to a process for obtaining a metallurgical bond between a metal material or a composite material having a metal matrix, and a metal casting piece, or a metal-alloy casting. In particular, the process makes it possible for predetermined regions of stationary or moving mechanical components to be reinforced by means of the introduction of inserts, and also make it possible for two or more cast pieces to be coupled with one another.

The known methods in the technical literature to generate a reinforced region inside a cast piece can be classified into the following two kinds of procedures:

Mechanical constriction of the insert by the solidified cast piece: this method uses the difference in thermal expansion between the cast piece and the insert. In this case, the bond is hence of non-metallurgical type: the obtained material is not continuous, and through the interface the seepage of corrosive agents can take place.

The insert should be surrounded by the cast material, and therefore cannot be positioned at a corner of the end product.

Infiltration, by means of the "squeeze casting" technique, of preformed pieces: an insert is not used in this technique. Instead a preformed piece, made in general from ceramic fibres and adequately positioned, is used through which the cast material is infiltrated by means of the application of a high pressure. In this case, a bond between the cast material and the insert is not obtained; this is, on the contrary, a technique for preparing composite materials.

On the other hand, the methods known from the prior art for generating a bond between a metal casting and another casting, or a composite material, are all related to welding or brazing techniques; such operations require an operating step to be carried out subsequently to the production of the cast pieces (or of the composite pieces).

The present Applicant has found that by means of a suitable surface treatment of the material (either a reinforcing material or a material to be coupled), a strong metallurgical bond can be obtained between the same material and the casting.

In particular, the process according to the present invention, which could be given the name of "welding by casting" or "cast-welding", guarantees that all of the classic requirements of the welding operations are met: namely, the removal of the surface impurities and oxides, and intimate contact and coalescence of the materials to be mutually bonded.

However, this type of welding is extremely different from other methods in that it takes place while the casting is being carried out.

Furthermore, metals not easily coupled by means of other techniques can be bonded to each other by means of such a type of welding.

The process according to the present invention for obtaining a metallurgical bond between a metal material, or a composite material having a metal matrix, and a metal casting, or a metal-alloy casting comprises carrying out a surface treatment on said material by means of the deposition of a thin layer of a metal, generally different from the metals contained in the material and in the same casting, which is capable of increasing the wettability of the metal of the cast material on the metal composite material, as well as the heat transfer coefficient between said two partners; and a step of casting around the same material, positioned inside a mould, of the metal, or the metal alloy the same casting is constituted by.

The metal material, which can be constituted of a single metal or of a metal alloy, or the metal-matrix composite can be, e.g., an insert for reinforcing predetermied regions of either stationary or moving mechanical components subject to wear, (such as guides, pistons, gearwheels, and so forth), or a cast piece to be coupled with one or more cast piece(s) in order to form a complex shaped piece, which either cannot be obtained otherwise or which is difficultly obtained owing to hindrances due to the geometry of the piece or to the type of material, or to a too high cost.

The metal composite material and the cast material can have different compositions preferably comprises metals selected from the group consisting of Al, Zn, Pb, Mg, Cu, Sn, In, Ag, Au, Ti and their alloys.

As hereinabove mentioned, the material can also be a composite having a metal matrix: such a material is constituted of a metal phase (or of a metal-alloy phase), which surrounds and bonds other phases, that constitute the reinforcement (powders or ceramic fibres).

The reinforcement is endowed with high values of mechanical strength and hardness, and to it the stresses are transferred, which the matrix is submitted to; the matrix, in its turn, should display suitable characteristics as a function of the forecast application type.

The reinforcement can be constituted by long or short ceramic fibres ($Al_2O_3$, SiC, C, BN, $SiO_2$, glass), or by ceramic "whiskers" (SiC, $Si_3N_4$, $B_4C$, $Al_2O_3$), or by non-metal powders (SiC, BN, $Si_3N_4$, $B_4C$, $SiO_2$, $Al_2O_3$, glass, graphite), or by metal fibres (Be, W, SiC-coated W, $B_4C$-coated W, steel).

The methods for preparing the composite can be the following:

Dispersion of the reinforcement throughout the matrix in the molten state;

Dispersion of the reinforcement throughout the matrix in a partially solid state;

Powder metallurgy;

Fibre metallization;

Layer compacting;

Infiltration.

The composite material can be obtained either directly, or by means of a subsequent mechanical machining.

The thickness of the metal which constitutes the thin layer to be deposited is preferably within the range of from 10 to 200 nm on the surface of the metal material or of the metal-matrix composite material. The thin-layer of metal may be different from the metals contained in the material and in the casting and are preferably selected from the group consisting of Au, Ag, Cu, Ni, Pt, Pd, Cr, W, Ir, Mo, Ta, Nb, Os, Re, Rh, Ru and Zr.

The deposition of said thin layer can be preferably carried out by sputtering, or by means of an electrochemical deposition process.

Any other known methods such as chemical and physical methods for generating surface coatings can be used as well: the methods of "plasma-spraying", laser-assisted deposition, thermal-evaporation deposition, magnetron-assisted deposition, CVD (Chemical Vapour Deposition), and the like, can be cited for exemplifying purposes.

By using a proper coating, the liquid to be submitted to the casting process will be capable of wetting the metal, or metal-matrix composite material to a high enough exent to transfer heat to it, to wash away the oxide layer existing on the surface of said material and to form a direct bond with the material, in case of a metal material, or with the metal matrix, in case of a composite material.

Once the material is adequately cleaned, coated and positioned inside the mold, the operating parameters of the casting step have to be adjusted so, as to insure that a proper stream of overheated liquid laps the surfaces of the material.

It is important that the position of the material be suitably selected and that the shape of the downwards ducts (feed ducts) and of the upwards ducts (outflow) inside the mold be so arranged as to oblige the liquid metal to lap, wet and wash the walls of the material before becoming too cold.

Summing-up, the matter is to control the following three parameters: temperature of material preheating, metal (or alloy) casting temperature, and flow conditions. In that way, an excellent metallurgical bond between the material and the cast material can be obtained.

The metal materials can be obtained by means of techniques known from the prior art (e.g.: gravity casting, pressure casting, or "squeeze casting"), either directly or with a subsequent processing step.

BRIEF DESCRIPTION OF THE DRAWINGS

FIG. 1: 1 is the graphite mold; 2 is the insert; 3 is the flowing direction of the casting stream; 4 is the tank.

FIG. 3: 1 is the mold; 2 is the insert; 3 is the flowing direction of the casting stream; 4 is the tank; 5 is the steel pipe.

FIG. 5: 1 is the mold; 2 is the insert; 3 is the flowing direction of the casting stream; 4 is the tank.

Some examples are now given in order to better illustrate the invention. In no way such examples should be regarded as limiting the invention:

EXAMPLE 1

The insert is constituted by an Al-Si alloy at 12% by weight of Si.

The insert is coated with a thin gold layer by sputtering.

The insert and the mould are pre-heated at the temperature of 300° C.

The material which constitutes the casting is a ZA11C1 alloy (11% by weight of Al, 1% by weight of Cu, the balance to 100% by weight of Zn).

The temperature of the cast material is of 625° C.

The volume of cast material is of about 200 $cm^3$.

The material is cast in a slow enough way (10 $cm^3$/second) through an orifice of 0.5 $cm^2$ of surface area from a height of about 10 cm above the upper edge of the mould, under a normal atmosphere.

In FIG. 1:

1 is the graphite mould;
2 is the insert;
3 is the flowing direction of the casting stream;
4is the tank.

Figure 2:
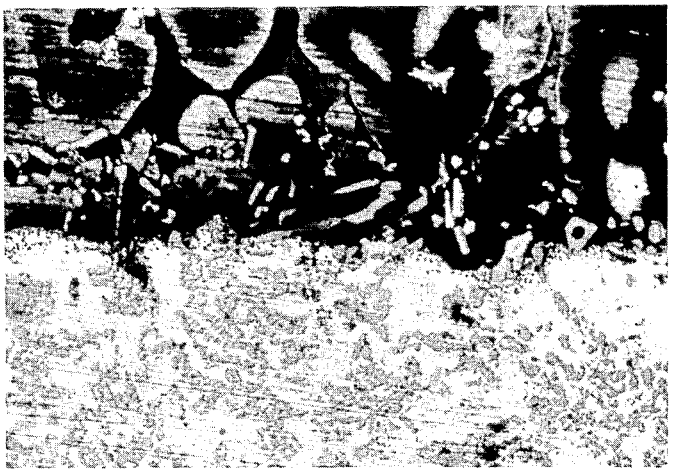
FIG. 2: Shows the results of Example 1.

Result of the experimental test: excellent bond, with practically indistinguishable interface after an examination carried out under the optical microscope on a cross section, after polishing and metallographic etching, as one can see from FIG. 2. The gray phase of Al-Si alloy results to be inside the ZA11C1 alloy, without any evidence of a planar interface, or of cracks.

EXAMPLE 2

The insert is a composite with a metal matrix constituted by ZA11C1 alloy (12% by weight of Al, 1% by weight of Cu, the balance to 100% by weight of Zn), the reinforcement is SiC powder at 15% by volume (average diameter 20$\mu$); it is obtained by infiltration.

The insert coated with a thin gold layer by sputtering.

The insert and the mould are pre-heated at the temperature of 300° C.

The cast material is a ZA11C1 alloy.

The temperature of the cast material is of 600° C.

The volume of cast material is of about 200 $cm^3$.

The material is cast in a fast enough way (30 $cm^3$/second) through an orifice of 1 $cm^2$ of surface area from a height of about 10 cm through a steel pipe, under an atmosphere of Ar.

In FIG. 3:

1 is the mould;
2 is the insert;
3 is the flowing direction of the casting stream;
4 is the tank;
5 is the steel pipe.

Figure 4:
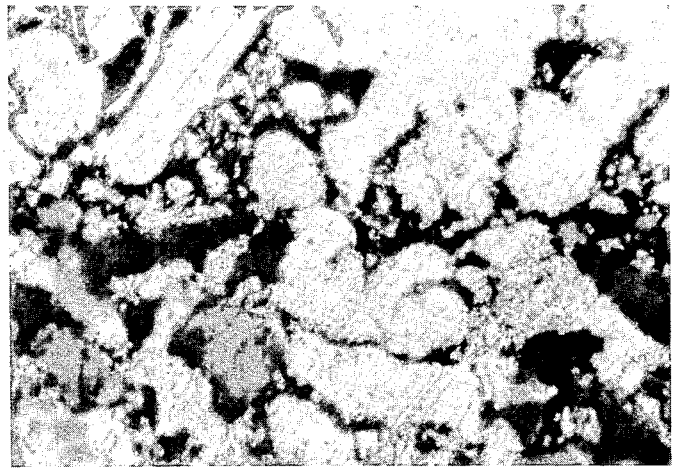
FIG. 4: Shows the results of Example 2.

Result of the experimental test: excellent bond, like in the preceding example, as it can be seen from FIG. 4. This microphotograph shows that, even at a high magnification, an interface between the cast material and the insert of the composite product cannot be identified.

EXAMPLE 3

The insert is a composite with a metal matrix constituted by an Al-Si alloy at 13% by weight of Si, the reinforcement is SiC powder at 50% by volume average diameter 20$\mu$). The insert is obtained by infiltration.

The temperature of the insert and of the mould is of 300° C.

The coating of the insert is obtained by means of the electrochemical deposition of Cu.

The cast material is an Al-Si alloy at 13% by weight of Si.

The temperature of the cast material is 650° C.

The volume of cast material is of about 200 $cm^3$, and said material is cast in a slow enough way (20 $cm^3$/second) through an orifice of 0.75 $cm^2$ of surface area into the mould.

In FIG. 5:

1 is the mould;
2 is the insert;
3 is the flowing direction of the casting stream;
4 is the tank.

Result of the experimental test: excellent bond. From the obtained piece specimens were prepared, which were submitted to tensile stress tests. The tensile strength is higher than 200 MPa and the specimens undergo breakage either inside the interior of the composite portion, or inside the matrix, and they do never break at the interface.

EXAMPLE 4

Example 4 was carried out in the same way as Example 1, with the following exceptions:

The insert is constituted by a composite with a metal matrix constituted by an Al-Si alloy (at 12% by weight of Si, 0.5% by weight of Mg, 0.3% by weight of Mn, with the balance to 100% being Al), to which Mg (2% by weight) is furthermore added. The reinforcement is constituted by SiC powder at 52% by volume.

The insert is coated with a thin Cu layer, deposited by means of an electrochemical deposition method., The insert and the mould are pre-heated at 270° C.

The cast material is a ZA27C2 alloy (an alloy consisting of a Zn-Al alloy at 27% by weight of Al and 2% by weight of Cu).

The temperature of the cast material is of 560° C.

The volume of cast material is of 200 $cm^3$.

Said material is cast in a slow enough way (10 $cm^3$/second, through an orifice of 0.5 $cm^2$ of surface area) from a height of about 10 cm above the upper edge of the mould under a normal atmosphere.

Result of the experimental test: excellent bond.

EXAMPLE 5

Example 5 was carried out in the same way as Example 2, with the following exceptions:

The insert is constituted by a composite with a metal matrix constituted by a ZA27C2 alloy (27% by weight of Al, 2% by weight of Cu, balance to 100% by weight Zn). The reinforcement is constituted by SiC powder at 50% by volume.

The insert is coated with a thin Cu layer by sputtering, after carrying out a preliminary etching cycle inside the same sputtering equipment.

The insert and the mould are pre-heated at 200° C.

The cast material is an Al-Si alloy ( 0.36% by weight of Fe, 0.05% of Mn, 1.20% of Mg, 11.6% of Si, 1.21% of Cu, 0.05% of Zn, 0.02% of Ti, 1.13% of Ni, balance to 100=Al), often used for manufacturing pistons.

The temperature of the cast material is of 650° C.

The volume of cast material is of about 150 $cm^3$.

Said material is cast into a mould in a fast enough way (30 $cm^3$/second, through an orifice of about 1 $cm^2$ of surface area) from a height of 60 cm, through a steel pipe under an $N_2$ atmosphere.

Result of the experimental test: excellent bond.

EXAMPLE 6

Example 6 was carried out in the same way as Example 3, with the following exceptions:

The insert is constituted by a composite with a metal matrix constituted by an Al-Si alloy ( 0.36% by weight of Fe, 0.05% of Mn, 1.20% of Mg, 11.6% of Si, 1.21% of Cu, 1.13% of Ni, 0.05% of Zn, 0.02% of Ti). The reinforcement is constituted by SiC powder at 30% by volume.

The insert is coated with a thin layer of Ag by sputtering.

The temperature of the insert and of the mould is of 300° C.

The cast material is a ZA11C1 alloy.

The temperature of the cast material is of 650° C.

The volume of cast material is of 150 $cm^3$, and said material is cast in a slow enough way (20 $cm^3$/second, through an orifice of 0.75 $cm^2$ of surface area).

Result of the experimental test: excellent bond. The specimens submitted to the tensile stress tests gave a value of 200 MPa before the breakage occurred inside the alloy of the cast material, very far away from the interface.

We claim:

1. Process for obtaining a metallurgical bond between a metal material or a composite material having a metal matrix, and a metal casting or a metal-alloy casting, which comprises carrying out a surface treatment on said material by means of the deposition of a thin layer of a metal, generally different from the metals contained in the material and in the casting, which is capable of increasing the wettability and heat transfer coefficient between the metal of the casting and the material, and a step of casting around the same metal composite material, positioned inside a mold, using the metal or the metal alloy of the casting.

2. Process according to claim 1, wherein the material to be bonded to a casting is a metal or a metal alloy.

3. Process according to claim 1, wherein the material is an insert used in order to reinforce a casting.

4. Process according to claim 1, wherein the material is a cast piece to be coupled with another cast piece.

5. Process according to claim 1, wherein the metals of the material and of the casting are selected from the group consisting of Al, Zn, Pb, Mg, Cu, Sn, In, Ag, Au, Ti and their alloys.

6. Process according to claim 1, wherein the composite material with metal matrix is provided with a reinforcement constituted by long or short ceramic fibres selected from the group consisting of $Al_2O_3$, SiC, BN, $SiO_2$ or glass.

7. Process according to claim 1, wherein the composite material with metal matrix is provided with a reinforcement constituted by ceramic "whiskers" selected from the group consisting of SiC, $Si_3N_4$, $B_4C$ and $Al_2O_3$.

8. Process according to claim 1, wherein the composite material with metal matrix is provided with a reinforcement constituted by non-metal powders selected from the group consisting of SiC, BN, $Si_3N_4$, $B_4C$, $SiO_2$, $Al_2O_3$, glass or graphite.

9. Process according to claim 1, wherein the composite material with metal matrix is provided with a reinforcement constituted by metal fibres selected from among Be, W, SiC-coated W, $B_4C$-coated W or steel.

10. Process according to claim 1, wherein the metal which constitutes the thin layer to be deposited on the surface of the material is selected from the group consisting of Au, Ag, Cu, Ni, Pt, Pd, Cr, W, Ir, Mo, Ta, Nb, Os, Re, Rh, Ru and Zr.

11. Process according to claim 1, wherein the deposition of a thin layer of metal takes place by sputtering.

12. Process according to claim 1, wherein the deposition of a thin layer of metal takes place by electrochemical deposition.

13. Process according to claim 1, wherein the deposition of a thin layer of metal takes place by "plasma-spraying" or laser-assisted deposition or thermal-evaporation deposition or magnetron-assisted deposition or CVD (Chemical Vapour Deposition).

14. Process according to claim 1, wherein the casting is produced by gravity casting or pressure casting, or "squeeze casting".

15. Process according to claim 1, wherein the metal material is produced by gravity casting or pressure casting or "squeeze casting" either directly or with a subsequent processing step.

16. Process according to claim 1, wherein the metal-matrix composite material is obtained by dispersing a reinforcing material throughout the matrix in the molten state, or by dispersing the reinforcing material throughout the matrix in a partially solid state, or by means of powder metallurgy, or by means of fibre metallization or layer compacting or infiltration.

17. Process according to claim 1, wherein the thin layer of metal to be deposited on the material has a thickness within the range of about 10 to 200 nm.

18. Process according to claim 1, wherein the metal-matrix composite material is obtained by dispersing a reinforcing material throughout the matrix in the molten state, or by dispersing the reinforcing material throughout the matrix in a partially solid state, or by means of powder metallurgy, or by means of fibre metallization or layer compacting or infiltration and is then submitted to mechanical machining.

* * * * *